United States Patent [19]

Kleykamp et al.

[11] 4,063,790

[45] Dec. 20, 1977

[54] FLUID CONDUIT ASSEMBLY

[75] Inventors: Donald L. Kleykamp, Springboro; Peter J. Neroni, Dayton; Victor M. Grabovez, Troy, all of Ohio; Homer N. Holden, Sylva, N.C.

[73] Assignee: Dayco Corporation, Dayton, Ohio

[21] Appl. No.: 732,570

[22] Filed: Oct. 15, 1976

[51] Int. Cl.[2] ..... H01R 3/04

[52] U.S. Cl. ..... 339/16 R; 339/59 R; 339/75 R; 339/91 R

[58] Field of Search ..... 339/16 R, 59 R, 59 M, 339/60 R, 60 C, 60 M, 61 R, 61 C, 61 M, 75 R, 75 A, 75 M, 75 T, 91 R, 91 L, 91 P

[56] References Cited

U.S. PATENT DOCUMENTS

| | | | |
|---|---|---|---|
| 3,034,085 | 5/1962 | Pauler et al. | 339/16 R |
| 3,165,369 | 1/1965 | Maston | 339/59 M |
| 3,258,553 | 6/1966 | Breslin | 339/59 R X |

*Primary Examiner*—Granville Y. Custer, Jr.
*Assistant Examiner*—DeWalden W. Jones
*Attorney, Agent, or Firm*—Reuben Wolk

[57] ABSTRACT

A fluid conduit assembly is provided and comprises a first and second conduit adapted to be easily connected and disconnected, a first electrical connector device carried by the first conduit and a second electrical connector device carried by the second conduit, and means locking the devices together with the first and second conduits connected with the locking means assuring electrical continuity through the electrical devices even upon exerting forces tending to pull the conduits apart.

8 Claims, 17 Drawing Figures

FLUID CONDUIT ASSEMBLY

BACKGROUND OF THE INVENTION

Tank or cannister type vacuum cleaners are widely used and many of such vacuum cleaners employ a fluid conduit assembly connected to a suitable tank at one end and a cleaning tool, or the like, at the other end with such cleaning tool often comprising a device, such as a cleaning brush, which is powered by an electric motor.

Fluid conduit assemblies proposed heretofore and used with tank type vacuum cleaners have mating electrical components which are easily separated and disconnected during normal operation of their associated vacuum cleaners. Accordingly, the need exists for a simple and economical fluid conduit assembly which may be used in tank type vacuum cleaners, or the like, and which employs electrical components which are locked together during use so as to prevent their separation.

SUMMARY

It is a feature of this invention to provide a fluid conduit assembly particularly adapted for use in tank or cannister type vacuum cleaners.

Another feature of this invention is to provide an economical fluid conduit assembly of the character mentioned having electrical components which are held in locking engagement even with loads being imposed on the fluid conduit assembly by rough service useage.

Another feature of this invention is to provide a fluid conduit assembly of the character mentioned which has a first and a second conduit adapted to be easily connected and disconnected, a first electrical connector device carried by the first conduit, a second electrical connector device carried by the second conduit, and means locking the electrical devices together with the first and second conduits connected, with the locking means assuring electrical continuity through the devices even upon exerting forces tending to pull the conduits apart.

Accordingly, it is an object of this invention to provide a fluid conduit assembly having one or more of the novel features set forth above or hereinafter shown or described.

Other details, features, objects, uses, and advantages of this invention will become apparent from the embodiments thereof presented in the following specification, claims, and drawings.

BRIEF DESCRIPTION OF THE DRAWINGS

The accompanying drawings show present preferred embodiments of this invention, in which.

DESCRIPTION OF ILLUSTRATED EMBODIMENTS

Figure 1:
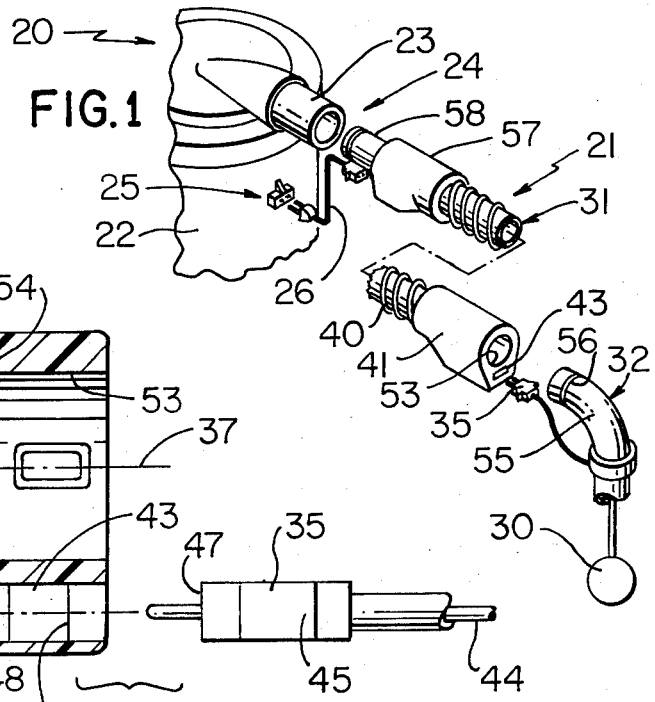
FIG. 1 is a perspective view with parts in cross section, parts shown schematically, and parts broken away illustrating a vacuum cleaning apparatus which employs an exemplary fluid conduit assembly of this invention.

Reference is now made to FIG. 1 of the drawings which illustrates a tank or cannister type vacuum cleaning apparatus 20 which employs one exemplary embodiment of a fluid conduit assembly of this invention which is designated generally by the reference numeral 21. The apparatus 20 has a suitable tank 22 which is provided with a vacuum tube 23 extending therefrom which is adapted to have the fluid conduit assembly suitably detachably connected thereto at 24 in a manner which is well known in the art. The apparatus 20 is provided with electrical power for operating a vacuum unit thereof from a suitable power source and in a manner which is well known in the art and thus such vacuum unit and power source are not shown. The apparatus 20 has a female electrical receptacle 25 mounted on its tank 22 and the receptacle 25 supplies power through a suitable electrical cord 26 to electrical means comprising the conduit assembly 21 and the electrical means in the conduit assembly supplies electrical power to an electric motor 30 provided at the terminal end of the assembly 21 and such motor is used to operate a cleaning brush or other suitable cleaning instrument.

The conduit assembly 21 comprises a first conduit means 31 and a second conduit means 32 adapted to be easily connected and disconnected and the conduit means 31–32 will be described in more detail subsequently. The conduit assembly 21 has a first electrical connector device 34 carried by the conduit means 31 (see FIGS. 2–4) and a second electrical connector device 35 carried by the conduit means 32. The assembly 21 has locking means 36 which assure electrical continuity through the devices 34 and 35 even upon exerting forces tending to pull the conduit means 31 and 32 apart and in this example of the invention, even upon exerting forces on conduit means 31–32 which are parallel to a longitudinal axis 37 at the area of junction of the conduit means 31–32 and tending to pull the electrical connector devices 34 and 35 apart.

The first conduit means 31 is in the form of a flexible hose assembly and will also be referred to as hose assembly 31 hereinafter; and such hose assembly is comprised of a flexible polymeric hose 40 and a collar 41 which is suitably fixed to an end portion of the hose 40. In this example of the invention, the collar 41 is in the form of a hose connector 41 which is made of a polymeric material and is bonded to the polymeric hose 40 as an integral part thereof. The collar or hose connector 41 has a pair of shoulders each designated by the same reference numeral 42 defined therein and the shoulders 42 comprise part of an opening or recess 43 which is adapted to receive the electrical connector device 35. The shoulders 42 in this example are disposed transverse the axis 37 and preferably are disposed perpendicular to such axis.

The electrical connector device 35 is in the form of a male electrical plug 35 having a pair of electrical wires or leads 44 suitably mechanically and electrically connected thereto. The device 35 also has a pair of yielding resilient shoulders each designated by the reference numeral 45 provided thereon and in the process of moving the device 35 within the recess 43, the shoulders 45 are compressed inwardly as indicated by the dotted lines at 46 in FIG. 3 and as a terminal end surface 47 of the device 35 bottoms against a cooperating surface 48 within the connector 41, the shoulders snap outwardly so that tip portions of inclined surfaces 49 thereof engage the shoulders 42. The snap action provided by the shoulders 45 is due to the fact that the device 35 is made of a compressible resilient polymeric material in which the cooperating shoulders 45 are defined thereon as an integral part thereof.

The connector device 35 is in the form of a male connector device or plug 35 having a pair of pins 50 extending therefrom. The connector device 34 is in the form of a female connector device having a pair of tubular members 51 and the tubular members are embedded within the polymeric material defining the hose connector 41. Upon connecting and locking the electrical connector devices 34 and 35 together, as indicated, above the pins 50 are received within the tubular members 51 and provide a firm electrical connection while the locking action is provided by the shoulders 45 springing into position against the shoulders 42 of the hose connector 41.

Figure 2:
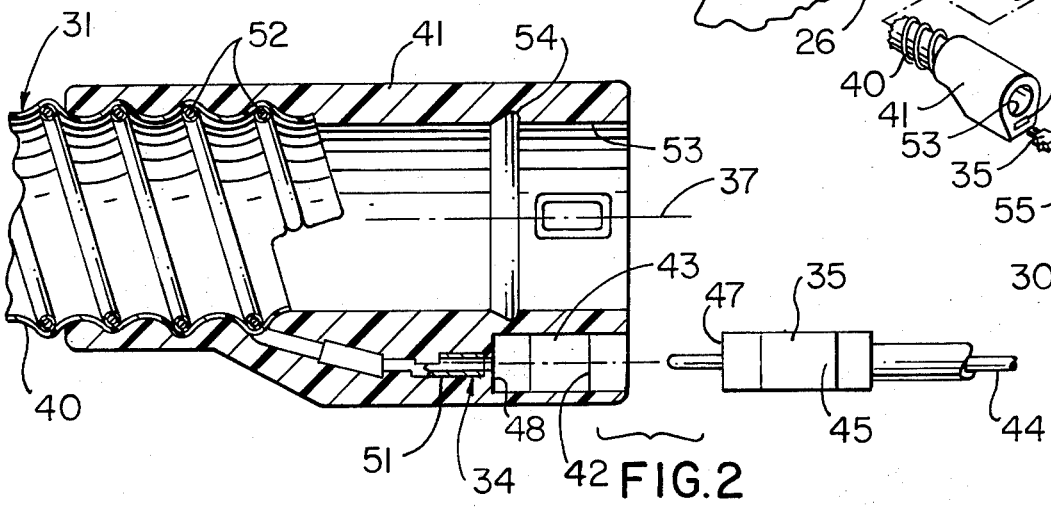
FIG. 2 is an enlarged cross section taken through a hose connector and female electrical connector device taken essentially on the line 2—2 of FIG. 1 and showing a side view of a male electrical connector device minus its associated supporting or carrying conduit means prior to installing such male connector device in position within the female electrical connector device.

The tubular members 51 comprising the female connector 44 are suitably fixed to associated electrical leads or wires each designated by the same reference numeral 52 in FIG. 2 of the drawings; and, it will be appreciated that the electrical wires 52 may be in the form of spring wires which serve both as electrical conductors and as means holding the comparatively thin tubular portion of the polymeric hose 40 against collapse and in a well known manner.

The hose connector 41 with its female electrical connection device 34 is provided at one end of the flexible hose assembly 31; and, it will be seen that the connector 41 has a tubular inlet 53 provided with an annular groove 54. The conduit means 32 comprises a comparatively rigid tubular portion 55 which is adapted to be received in the inlet 53 and the tubular portion has an annular bead or convolution 56 therein which is nested within the groove 54 and assures the conduit means 32 is held firmly in position during operation of the apparatus 20.

The conduit means or flexible hose assembly 31 also has a hose connector 57 at its opposite end which has a comparatively rigid tubular portion 58 suitably fixed thereto and the portion 58 is adapted to be detachably connected to the vacuum tube 23 extending from the tank 22. Further, the hose connector 57 may also be made of a polymeric material similar to the connector 41 and may have suitable electrical connector means embedded therein with such connector means being adapted to receive a mating connector of the electrical cord 26.

Figure 3:
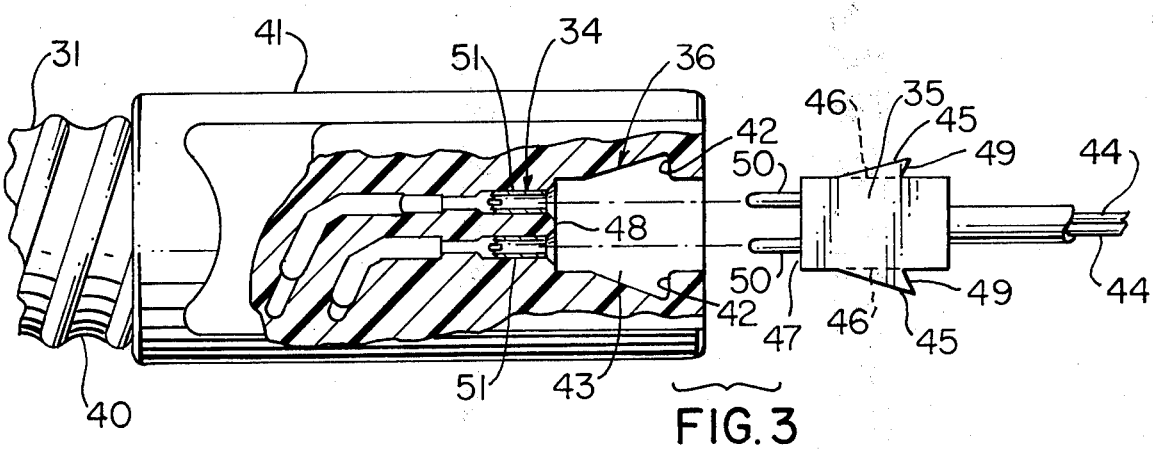
FIG. 3 is a view similar to FIG. 2 particularly illustrating a cross-section through the female electrical connector device of FIG. 1 taken 90° from the plane of the cross section of FIG. 2 and showing a bottom view of the male connector device.
Figure 4:
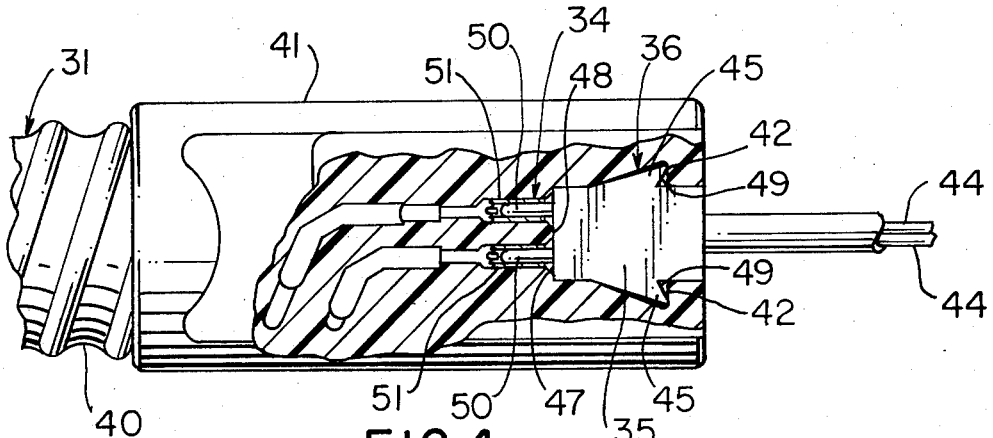
FIG. 4 is a view similar to FIG. 3 again minus the conduit means which carries the male connector device and illustrating the electrical connector devices connected and locking means thereof holding such devices locked together.

In this disclosure of the invention it will be seen that in FIGS. 2–4 of the drawings the conduit means 32 of the conduit assembly 21 has not been shown except for the electrical connection device 35 of such conduit means 32 and this has been achieved for ease of drawing presentation; however, it is to be understood that the conduit assembly 21 is comprised of fluid conduits 31 and 32.

Other exemplary embodiments of the fluid conduit assembly of this invention are illustrated in FIGS. 5–8, 9–10, 11–12, 13–15, and 16–17. The fluid conduit assemblies illustrated in FIGS. 5–8, 9–10, 11–12, 13–15, and 16–17 are similar to the fluid conduit assembly 21; therefore, such conduit assemblies will be designated by the reference numerals 21A, 21B, 21C, 21D, and 21E in FIGS. 5–8, 9–10, 11–12, 13–15, and 16–17, respectively and component portions of each conduit assembly which are similar to corresponding portions of the assembly 21 will be designated in the drawings by the same reference numerals as in the assembly 21 (whether or not such component portions are mentioned in the specification) followed by the associated letter designation, either A, B, C, D, or E and not described again in detail. Only those component portions of each conduit assembly which are different from corresponding portions of the conduit assembly 21 will be designated by a new reference numeral also followed by the associated letter designation and described in detail.

As in the case of the conduit assembly 21, it will be seen that in each embodiment of the invention the fluid conduit means corresponding to the conduit means 32 of assembly 21 is not shown interconnected with its corresponding hose connector (except in FIG. 9); however, it is to be understood that fluid conduit means similar to conduit means 32 and associated component portions is in each instance connected to a hose connector similar to connector 41. Accordingly, assembly 21A is defined by hose assembly 31A and conduit means 32A, assembly 21B is defined by hose assembly 31B and conduit means 32B, assembly 21C is defined by hose assembly 31C and conduit means 32C, assembly 21D is defined by hose assembly 31D and conduit means 32D, and assembly 21E is defined by hose assembly 31E and conduit means 32E.

In the conduit assembly 21A of FIGS. 5–8, the tubular member 51A has slot means 59A defined therein, such slot means being provided with edge means or rear edges 60A. In addition, each of the pins 50A of the electrical male connector device 35A has a pair of wedge-shaped portions 61A extending from diametrically opposite side edges thereof and the male connector plug 35A is of rectangular outline and is received within a corresponding opening in the hose connector 41A which is also of rectangular peripheral outline and is designated by the reference numeral 62A.

The locking means of conduit assembly 21A is designated by the reference numeral 36A and is defined by the wedge-shaped portions 61A being received within the slot means 59A and once received therewithin, transverse surface portions 63A provided on the wedge-shaped portions 63A are received in locking engagement against edges 60A comprising the slot means 59A and lock the male connector plug 35A in position. Accordingly, the locking means 36A is defined by parts of components which provide the electrical contact and electrical continuity between the electrical connector devices of assembly 21A and in particular are provided by portions of the female connector device 34A and the male connector device 35A.

Figure 5:
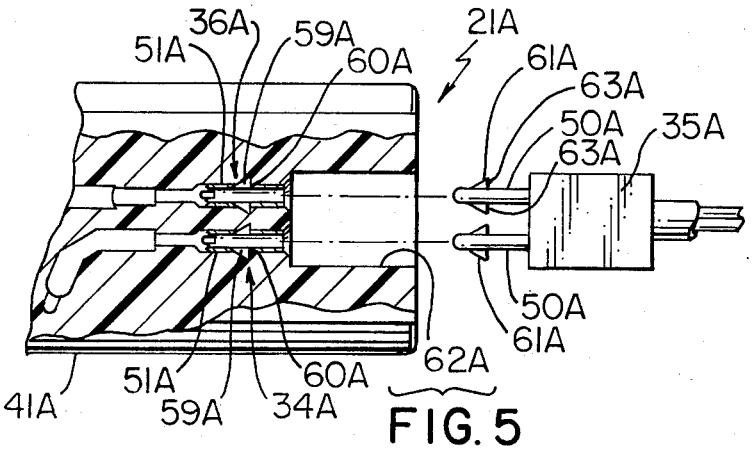
FIGS. 5 and 6 are views similar to FIGS. 3 and 4 respectively, illustrating another exemplary embodiment of a conduit assembly of this invention and another embodiment of locking means for electrical devices thereof.
Figure 7:
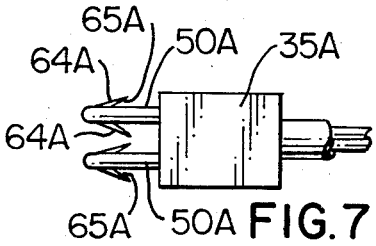
FIGS. 7 and 8 are views of a pair of modified electrical connector devices each of which may be used in lieu of the male electrical connector device of FIGS. 5 and 6.
Figure 6:
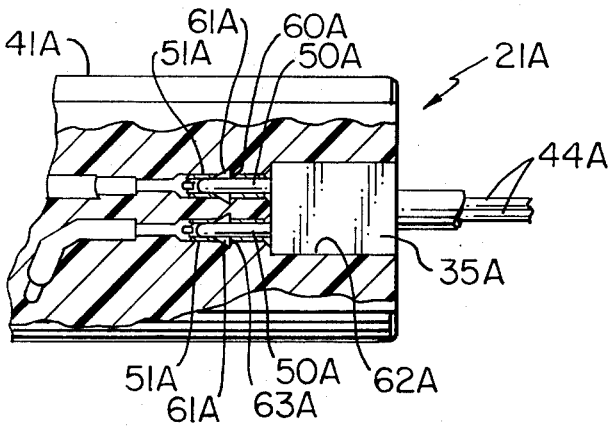
Figure 8:
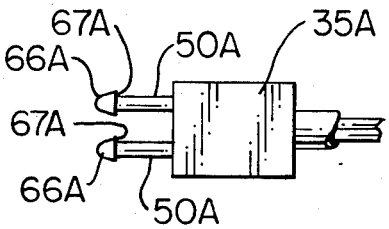

Modifications of the locking means of FIGS. 5 and 6 are illustrated in FIGS. 7 and 8. In FIG. 7, it will be seen that the male connector plug 35A has pins 50A provided with diametrically arranged barb-like portions 64A extending from diametrically opposite locations thereof and the barb-like portions are adapted to be received within the slot means 59A and held in locking engagement by inclined surface portions 65A thereof engaging the edges 60A provided on the tubular members 51A comprising the female connector device 34A. In FIG. 8, the male connector plug 35A has pins 50A provided with enlarged substantially frustoconical head portions 66A and the head portions 66A are adapted to be received within the tubular members 51A in a wedged manner. The slot means 59A provided in each tubular member 51A allow radially outward expansion of a tubular member 51A once a frustoconical portion 66A is pushed therein and once a pin 51A and head portion 66A are pushed in position surface portions 67A of portions 66A prevent withdrawal of the pin 50A and hence its male connector plug 35A.

Figure 9:
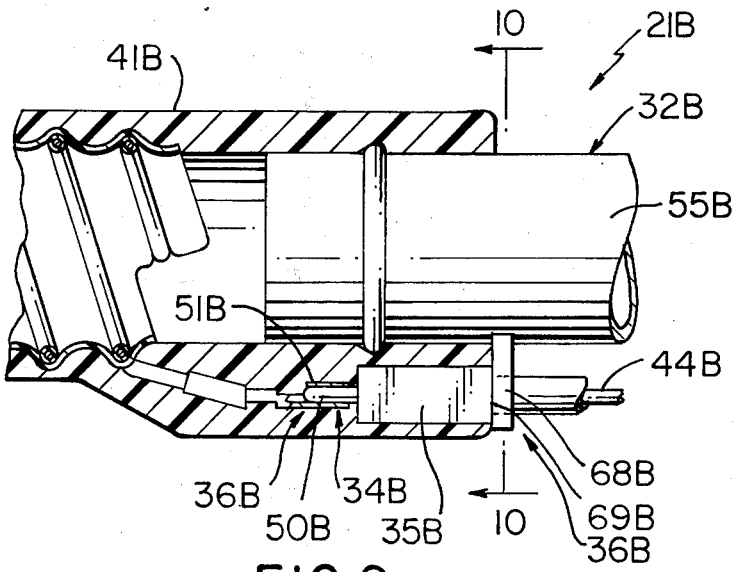
FIG. 9 is a view similar to FIG. 4 of another exemplary embodiment of a conduit assembly of this invention having another embodiment of locking means for electrical devices thereof.
Figure 10:
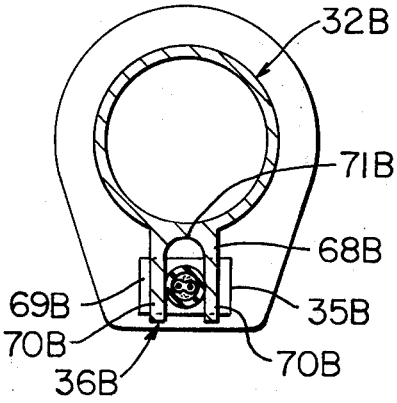
FIG. 10 is a view taken essentially on the line 10—10 of FIG. 9.

The assembly 21B of FIGS. 9 and 10 has its conduit means 32B provided with an extension 68B extending therefrom and the extension 68B is adapted to be urged against the male electrical connector plug 35B and in particular against the rear surface 69B thereof to in essence serve as locking means 36B locking the plug 35B in position within the female electrical connector 34B. In this embodiment the male electrical connector plug 35B has pins 50B provided with smooth outside surfaces and pins 50B are received within tubular members 51B having smooth inside surfaces. The extension 68B of this example is in the form of a substantially U-shaped extension having parallel leg portions 70B extending downwardly from a bright 71B thereof which coincides with the rigid tubular portion 55B of conduit means 32B; and, the leg portions 70B are spaced apart so as to allow the insulated wires 44B extending from the male connector plug 35B to extend between the leg portions 70B in an unobstructed manner.

Figure 11:
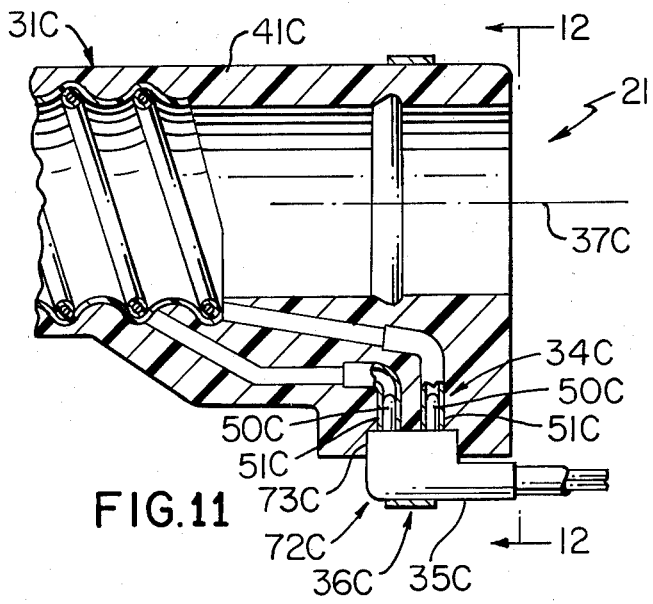
FIG. 11 is a view similar to FIG. 4 of another exemplary embodiment of a conduit assembly of this invention having another embodiment of locking means for the electrical connector devices thereof.
Figure 12:
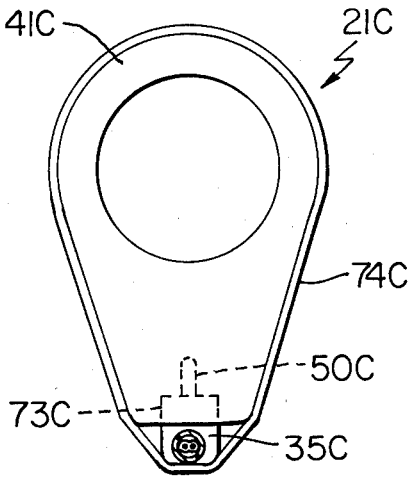
FIG. 12 is a view taken essentially on the line 12—12 of FIG. 11.

The conduit assembly 21C of FIGS. 11 and 12 has a male electrical connector device or plug 35C provided with pins 50C and a female electrical connector device 34C provided with tubular members 51C and it will be seen that the connector plug 35C has a substantially L-shaped configuration as indicated at 72C and the electrical connector 35C is disposed in the hose connector 41C with the axis of the tubular members 51C and pins 50C disposed substantially perpendicular to the axis 37C. The polymeric hose connector 41C has a recess 73C which receives a portion of the connector 35C and upon applying pulling forces parallel to the axis 37C tending to pull the conduit means 31C and 32C apart, surfaces in the hose connector 41C and defining the recess 73C prevent the electrical connectors 34C and 35C from being pulled apart. The locking means 36C in this example of the invention comprises a band-like member 74C which may be made of any suitable material (including metallic or non-metallic materials) and the band-like member is such that it conforms to the configuration of the hose connector 41C while extending around the plug 35C and as shown in FIG. 12. The band-like member 74C serves to lock the electrical connectors 34C and 35C together once the conduit means 31C and 32C are connected. The band-like member or band 74C may be made of a substantially expandible elastic material which tends to hold the plug 35C yieldingly urged within its associated connector 34C. The band 74C may also be made of a rigid nonextensible material which may be slid parallel to axis 37C to provide its locking and unlocking function.

Figure 13:
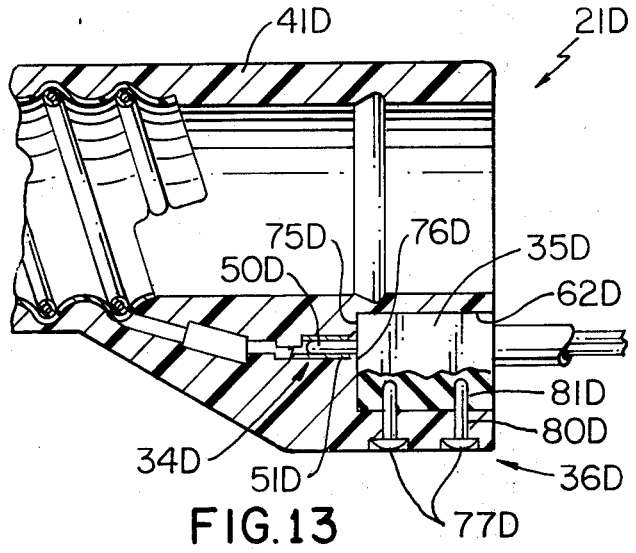
FIG. 13 is a view similar to FIG. 4 illustrating another exemplary embodiment of a conduit assembly of this invention having another embodiment of locking means for the electrical connector devices thereof.
Figure 14:
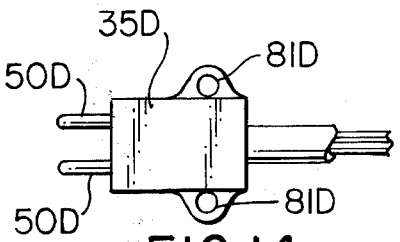
FIGS. 14 and 15 are views of a pair of modified electrical connector devices each of which may be employed in lieu of the male electrical connector device of FIG. 13.
Figure 15:
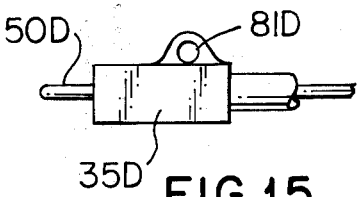

In the exemplary embodiment of the conduit assembly 21D illustrated in FIGS. 13–15, it will be seen that the male connector plug 35D is received within a recess 62D with pins 50D of plug 35D being received within tubular members 51D of the female electrical connector 34D. It will also be seen that the connector plug 35D has an inside surface 75D which is adapted to be received against a cooperating surface 76D of the hose connector 41D.

The locking means 36D is in the form of a pair of frictionally held pins each designated by the same reference numeral 77D and each pin 77D extends through cooperating aligned openings 80D and 81D in the hose connector 41D and plug 35D respectively. It will also be appreciated that the male connector plug 35D instead of having openings 81D provided therein as shown in FIG. 13 may have a pair of openings also designated by the reference numeral 81D as shown in FIG. 14 or a single opening 81D as shown in FIG. 15 and in each instance with the connector plug 35D shown in FIGS. 14 and 15 corresponding openings 80D (not shown) will be provided in the connector 41D to assure friction pins 77D may be inserted in position to lock the plug in position and define the locking means 36D. It will also be appreciated that instead of friction pins 77D, threaded screws or the like may be used for the same purpose.

Figure 16:
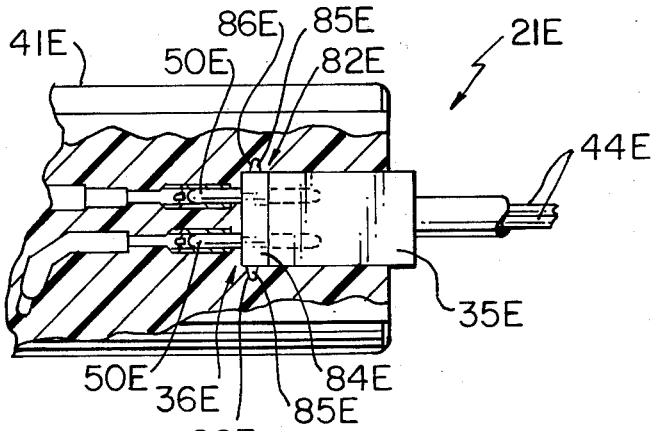
FIG. 16 is a view similar to FIG. 4 illustrating another exemplary embodiment of a conduit assembly of this invention having another embodiment of locking means for the electrical connector devices thereof.
Figure 17:
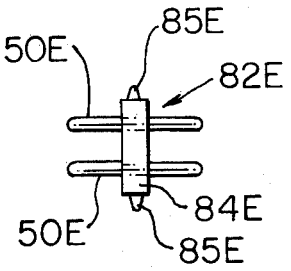
FIG. 17 is a view in elevation illustrating locking means comprising the male electrical connector device shown in FIG. 16.

The assembly 21E of FIGS. 16 and 17 comprises a male connector plug 35E which has an H-shaped assembly 82E provided at the terminal end thereof and suitably fixed thereto as an integral part thereof. The assembly 82E has pins 50E which are suitably fixed to electrical leads 44E of the connector plug 35E and has a transverse bar 84E provided at the terminal end thereof with portions of pins 50E extending outwardly of the transverse bar 84E. The transverse bar has projections 85E extending from opposite sides thereof which are adapted to be snap fitted within recesses 86E provided in the hose connector 41E whereby the projections 85E and recesses 86E, in essence, define the locking means 36E for the electrical connector devices of the assembly 21E.

The hose assemblies 31 and 31A–E with their various hose connectors may be made of any suitable polymeric material known in the art. The electrical connectors may have any suitable material comprising their electrically conducting portions and their non-conducting or insulating portions may be made of a suitable polymeric material. Any suitable polymeric material may be used such as high molecular weight polymers including but not being limited to polyvinyl chloride, polyethylene, polypropelene, nylon, and the like.

While present exemplary embodiments of this invention, and methods of practicing the same, have been illustrated and described, it will be recognized that this invention may be otherwise variously embodied and practiced within the scope of the following claims.

What is claimed is:

1. A fluid conduit assembly comprising, a first and a second conduit means adapted to be connected and disconnected, a first electrical connector device carried by said first conduit means, a second electrical connector device carried by said second conduit means, and means locking said electrical connector devices together with same first and second conduit means connected, said locking means assuring electrical continuity through said devices even upon exerting forces tending to pull said conduit means apart; said first conduit means being a flexible polymeric hose comprising a collar having at least one shoulder therein disposed transverse a longitudinal axis of said hose, said collar comprising a polymeric hose connector bonded to said hose as an integral part thereof; said first electrical connector device comprising a female connector device embedded in said hose connector; said second electrical connector device comprising a male connector device comprised of a compressible resilient polymeric material having a shoulder defined thereon having a compressible resilient apex being adapted to be yieldingly compressed and urged into locking engagement with said shoulder in said collar so that said shoulders comprise said locking means, said compressible apex returning to its original configuration after release of compressive forces thereon and serving to engage said shoulder in said collar and yieldingly hold said male connector device in locking engagement.

2. A fluid conduit assembly comprising, a first and a second conduit means adapted to be connected and disconnected, a first electrical connector device carried by said first conduit means, a second electrical connector device carried by said second conduit means, and means locking said devices together with said first and second conduit means connected, said locking means assuring electrical continuity through said devices even upon exerting forces tending to pull said conduit means apart, said first electrical connector device being a female connector device having a pair of tubular members and said second electrical connector device comprising a male connector device having a pair of pins, each of said pins being adapted to be received in an associated tubular member, each of said tubular members having slot means defined therein with said slot means being provided with edge means, each of said pins having at least one wedgedshaped portion therein adapted to be received in an associated slot means, said wedge-shaped portion cooperating with said slot means to define said locking means.

3. A fluid conduit assembly comprising, a first and a second conduit means adapted to be connected and disconnected, a first electrical connector device carried by said first conduit means, a second electrical connector device carried by said second conduit means, and means locking said devices together with said first and second conduit means connected, said locking means assuring electrical continuity through said devices even upon exerting forces tending to pull said conduit means apart, said first electrical connector device being a female connector device having a pair of tubular members and said second electrical connector device comprising a male connector device having a pair of pins, each of said pins being adapted to be received in an associated tubular member, each of said tubular members having slot means defined therein with said slot means being provided with edge means, each of said pins having at least one barb-like portion therein adapted to be received in an associated slot means, said barb-like portion cooperating with said slot means to define said locking means.

4. A fluid conduit assembly comprising, a first and a second conduit means adapted to be connected and disconnected, a first electrical connector device carried by said first conduit means, a second electrical connector device carried by said second conduit means, and means locking said electrical connector devices together with said first and second conduit means connected, said locking means assuring electrical continuity through said devices even upon exerting forces tending to pull said conduit means apart; said first electrical connector device being a female connector device having a pair of tubular members each having a slot means defined therein with said slot means being provided with edge means; said second electrical connector device comprising a male connector device having a pair of pins each adapted to be received in an associated tubular member.

5. An assembly as set forth in claim 4 in which each of said pins has an enlarged substantially frustoconical head portion including a near transverse surface portion, each frustoconical head portion being adapted to be received in an associated tubular member in wedged relation, said slot means of each tubular portion allowing radial expansion thereof and receipt of an associated frustoconical head portion therewithin with each transverse surface portion holding its pin against withdrawing movement.

6. A fluid conduit assembly comprising, a first and a second conduit means adapted to be connected and disconnected, a first electrical connector device carried by said first conduit means, a second electrical connector device carried by said second conduit means, and means locking said electrical connector devices together with said first and second conduit means connected, said locking means assuring electrical continuity through said devices even upon exerting forces tending to pull said conduit means apart, said locking means comprising a band-like member yieldingly holding said first and second electrical connector devices together with said conduit means connected.

7. A fluid conduit assembly comprising, a first and a second conduit means adapted to be connected and disconnected, a first electrical connector device carried by said first conduit means, a second electrical connector device carried by said second conduit means, and means locking said devices together with said first and second conduit means connected, said locking means assuring electrical continuity through said devices even upon exerting forces tending to pull said conduit means apart, said locking means comprising a band-like member yieldingly holding said first and second electrical connector devices together with said conduit means connected, said first electrical connector device being a female connector device having a pair of tubular members extending substantially perpendicular to a common axis of said conduit means at their area of connection, said second electrical connector device comprising a male connector device having a pair of pins which each of said pins being adapted to be received in an associated tubular member, and said band-like member holding said second electrical connector device against movement perpendicular to said axis.

8. A fluid conduit assembly comprising, a first and a second conduit means adapted to be connected and disconnected, a first electrical connector device carried by said first conduit means, a second electrical connector device carried by said second conduit means, and means locking said devices together with said first and second conduit means connected, said locking means assuring electrical continuity through said devices even upon exerting forces tending to pull said conduit means apart, said first electrical connector device being a female connector device having a pair of tubular members and said second electrical connector device comprising a male connector device having a pair of pins, each of said pins being adapted to be received in an associated tubular member, said pair of pins comprising part of an H-shaped pin assembly, said H-shaped assembly having a transverse bar, and said transverse bar having a pair of projections adapted to be held in locking engagement by wall means defining cooperating recesses in said hose connector.

* * * * *